US012533596B2

(12) United States Patent
Vance et al.

(10) Patent No.: US 12,533,596 B2
(45) Date of Patent: Jan. 27, 2026

(54) SYSTEM AND METHOD FOR AN ON-BOARD ANIMATED FIGURE IN A RIDE ENVIRONMENT

(71) Applicant: Universal City Studios LLC, Universal City, CA (US)

(72) Inventors: Eric Allan Vance, Orlando, FL (US); Sarah Anne Kelley, Orlando, FL (US)

(73) Assignee: UNIVERSAL CITY STUDIOS LLC, Universal City, CA (US)

( * ) Notice: Subject to any disclaimer, the term of this patent is extended or adjusted under 35 U.S.C. 154(b) by 502 days.

(21) Appl. No.: 18/076,910

(22) Filed: Dec. 7, 2022

(65) Prior Publication Data

US 2024/0189733 A1 Jun. 13, 2024

(51) Int. Cl.
*A63G 25/00* (2006.01)
*A63G 31/02* (2006.01)

(52) U.S. Cl.
CPC ..... *A63G 25/00* (2013.01); *A63G 31/02* (2013.01)

(58) Field of Classification Search
CPC ..... A63G 25/00; A63G 31/02; A63G 31/06
See application file for complete search history.

(56) References Cited

U.S. PATENT DOCUMENTS 1,803,397 A * 5/1931 La Rizza ..... A63G 31/16 472/44
1,982,391 A * 11/1934 Markey ..... A63G 25/00 472/27
3,713,652 A * 1/1973 Rakestraw ..... A63G 31/02 446/482
7,691,002 B2 4/2010 Casey et al.
9,464,754 B1 10/2016 Troy et al.
9,488,987 B2 11/2016 Goulding
10,688,401 B1 6/2020 Brister et al.
10,825,196 B2 11/2020 Lin et al.
11,207,606 B2 * 12/2021 Smith ..... A63G 31/02
11,533,557 B2 * 12/2022 Hall ..... G06F 3/016
11,562,539 B2 * 1/2023 Goergen ..... A63F 13/28
11,701,595 B2 * 7/2023 Chatrath ..... A63G 31/02 472/137
2016/0023121 A1 1/2016 McVeen
(Continued)

OTHER PUBLICATIONS

PCT/US2023/082734 International Search Report and Written Opinion mailed Apr. 23, 2024.

*Primary Examiner* — Magdalena Topolski
(74) *Attorney, Agent, or Firm* — Fletcher Yoder, P.C.

(57) ABSTRACT

An amusement attraction includes a ride vehicle or show action equipment and an animated figure configured to move along a surface of the ride vehicle or the show action equipment. The animated figure includes at least three points of contact configured to engage with the surface, wherein the at least three points of contact include a first point of contact and a second point of contact configured to be alternately engaged with and disengaged from the surface, and a third point of contact configured to maintain contact with the surface. The amusement attraction includes a fixation system configured to keep the animated figure coupled via the at least three points of contact as the animated figure moves along the surface. The amusement attraction includes a controller configured to provide control signals to the fixation system to facilitate control of engagement of the animated figure along the surface.

18 Claims, 8 Drawing Sheets

(56) References Cited

U.S. PATENT DOCUMENTS

| | | | | |
|---|---|---|---|---|
| 2016/0059939 | A1 | 3/2016 | Lamonby et al. | |
| 2022/0143518 | A1 | 5/2022 | Chatrath et al. | |
| 2023/0158422 | A1* | 5/2023 | Shum | A63J 19/006 472/84 |
| 2024/0402728 | A1* | 12/2024 | Vance | G05D 1/2446 |
| 2025/0026021 | A1* | 1/2025 | Vance | A63J 1/02 |

* cited by examiner

SYSTEM AND METHOD FOR AN ON-BOARD ANIMATED FIGURE IN A RIDE ENVIRONMENT

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Since the early twentieth century, amusement parks (or theme parks) have substantially grown in popularity. Amusement parks contain a variety of rides and shows to provide unique experiences to each guest. With the increasing sophistication and complexity of modern attractions, and the corresponding increase in expectations among amusement park and/or theme park guests, improved and more creative attractions are needed to keep attracting guests and to provide unique experiences to the guests.

BRIEF DESCRIPTION

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In an embodiment, an amusement attraction includes a ride vehicle or show action equipment and an animated figure configured to move along a surface of the ride vehicle or the show action equipment, wherein the animated figure includes at least three points of contact configured to engage with the surface, wherein the at least three points of contact include a first point of contact and a second point of contact configured to be alternately engaged with and disengaged from the surface, and a third point of contact configured to maintain contact with the surface. The amusement attraction further includes a fixation system configured to keep the animated figure coupled to the ride vehicle or the show action equipment via the at least three points of contact as the animated figure moves along the surface. The amusement attraction even further includes a controller configured to provide control signals to the fixation system to facilitate control of engagement of the animated figure along the surface.

In an embodiment, a ride vehicle includes a surface. The ride vehicle also includes an animated figure disposed on the surface and configured to crawl along the surface along a planned path, wherein the animated figure includes at least three points of contact configured to contact the surface, wherein the at least three points of contact include a first point of contact and a second point of contact configured to be alternately coupled and uncoupled to the surface, and a third point of contact configured to maintain contact with the surface. The ride vehicle further includes a fixation system configured to keep the animated figure coupled to the ride vehicle as the animated figure moves along the surface. The ride vehicle still further includes a controller configured to provide control signals to the fixation system to facilitate control of engagement of the animated figure along the surface.

In an embodiment, a method for controlling an animated figure in a ride environment includes providing, via a first controller on a ride vehicle, control signals to a selectively activate and deactivate fixation devices disposed on a surface of the ride vehicle that cause the animated figure disposed on the ride vehicle to remain coupled to the surface as the animated figure crawls along the surface along a planned path, wherein the animated figure includes at least three points of contact configured to engage and disengage the surface, wherein the at least three points of contact include a first point of contact, a second point of contact, and a third point of contact, the first point of contact and the second point of contact are configured to be alternately coupled and uncoupled to the surface while the third point of contact is configured to maintain contact with the surface. The method also includes receiving, at a second controller on the animated figure, the control signals to cause one or more actuators on the animated figure to alternately move the first point of contact and the second point of contact along the planned path in coordination with the selective activation and deactivation of the fixation devices to cause the animated figure to move along the surface.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
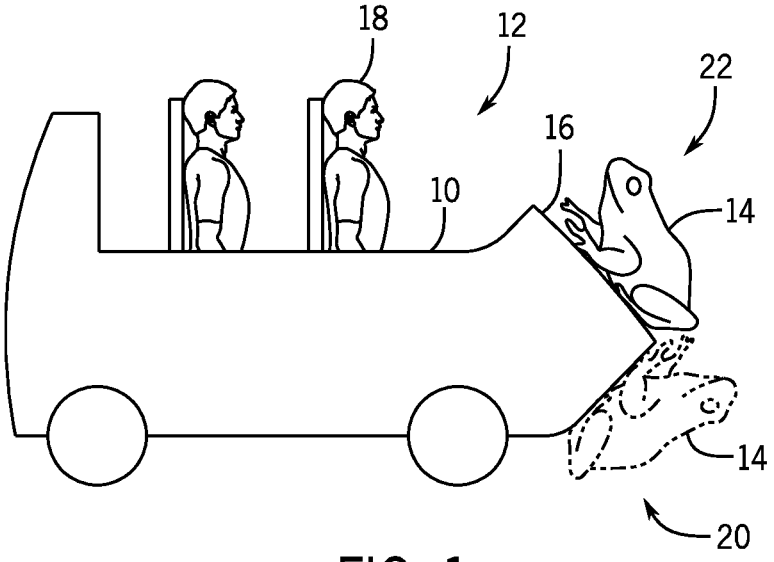
FIG. 1 is a schematic view of a ride vehicle in a ride environment wherein an animated figure is depicted as moving (e.g., crawling) along a surface of the ride vehicle, in accordance with aspects of the present disclosure.

The present disclosure relates generally to an animated figure, such as a robotic assembly that operates to create movement that mimics a character (e.g., an animal, futuristic robot, human) for entertainment purposes.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure are directed to systems and methods for controlling movement of an animated figure in an entertainment environment (e.g., ride system environment). In particular, the animated figure may be disposed on a surface of movable entertainment equipment (e.g., a ride vehicle or show action equipment) in a translatable manner and configured to move (e.g., crawl) along a planned path on the surface. As a specific example, the animated figured may be positioned on a ride vehicle's surface. The animated figure, during operation of the ride vehicle (e.g., while a ride vehicle is traversing a ride path), may initially be located out of a view of a rider on the ride vehicle and then subsequently move into the view of the rider. It should be noted that the term "surface," as used in the present disclosure, may broadly include a unified surface (e.g., a hood of a ride vehicle) or separate components (e.g., pads, tiles, blocks, pipes) that form an outwardly visible aspect of a ride vehicle, show action equipment, or the like.

In an embodiment, an animated figure includes at least three points (discrete points of contact) for contact with the surface, wherein the at least three points of contact include a first point of contact, a second point of contact, and a third point of contact. Some of these points of contact are movable and allow for engagement (e.g., contact) and disengagement (e.g., removal from contact) with the surface. For example, the first point of contact and the second point of contact may be configured to be alternately coupled and uncoupled to the surface while the third point of contact is configured to maintain constant contact (e.g., sliding or rolling contact) with the surface. The animated figure also includes one or more actuators that, in response to control signals from a controller, cause the first point of contact and the second point of contact to alternately move along the planned path to enable the animated figure to move.

In accordance with present embodiments, the points of contact are part of or cooperate with a fixation system. The fixation system includes fixation devices that are selectively activated and deactivated, in response to control signals from a controller, to keep the animated figure coupled to the surface as the animated figure moves along the surface. In certain embodiments, the surface includes switchable electromagnets or switchable permanent (e.g., rare earth) magnets disposed along the planned path while the points of contact of the animated figure include magnets. Switchable electromagnets are electromagnets where the power to the electromagnet can be reduced or turned off (e.g., via a switch) to control the electromagnet strength. Switchable permanent magnets are magnets coupled to an actuator that moves the magnet into and out of position to facilitate engagement (e.g., changing the orientation of the magnetic field). In certain embodiments, the points of contact of the animated figure include switchable electromagnets or switchable permanent magnets and the surface includes magnets disposed along the planned path. In certain embodiments, the points of contact of the animated figure include switchable electromagnets or switchable permanent magnets and the surface includes a magnetic material (e.g., ferromagnetic material). In certain embodiments, the surface includes holes that that selectively provide suction (e.g., via a vacuum pump) to hold the points of contact of the animated figure. In certain embodiments, the points of contact selectively provide suction (e.g., via a vacuum pump) to hold the points of contact in holes on the surface. The disclosed embodiments enable unique effects and features to be seen by guests in a ride or show environment.

Figure 14:
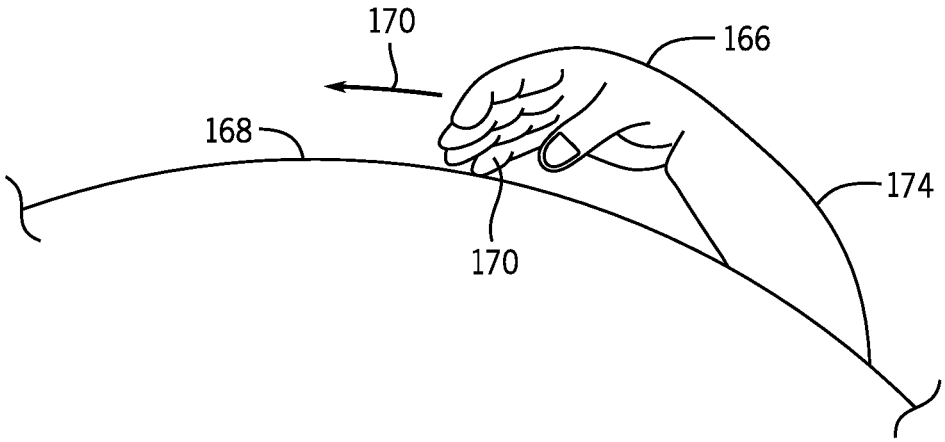
FIG. 14 is a schematic view of an animated figure moving along (and externally coupled to) a surface having at least one permanent point to point connection for a point of contact.

FIG. 1 is a schematic view of a ride vehicle 10 in a ride environment 12 (e.g., of an amusement attraction at an amusement or theme park) having an animated FIG. 14 moving (e.g., crawling) on a surface 16 of the ride vehicle 10. As depicted, the ride vehicle 10 is moving through the ride environment 12. The ride vehicle 10 includes riders or passengers 18 seated within the ride vehicle 10. As depicted, the animated FIG. 14 is disposed on the surface 16 of the ride vehicle 10. The animated FIG. 14 may be any shape or body type. The animated FIG. 14 may include any number of appendages or limbs. In certain embodiments, the animated FIG. 14 may not include any limbs (e.g., a snake or worm-like body). As depicted, the animated FIG. 14 is a frog. The animated FIG. 14 is coupled to the surface 16 in a non-permanent manner. In certain embodiments, the animated FIG. 14 is coupled to the surface 16 in a permanent manner. As discussed in greater detail below, a system is utilized to control movement (e.g., crawling) of the animated FIG. 14 along a path or route on the ride vehicle 10 (e.g., on an exterior surface of the ride vehicle 10) while it moves through the ride environment 12. In particular, the system includes a fixation system (or attachment system) that includes fixation devices (or attachment devices) disposed along a planned path (e.g., on or in the surface 16) of the ride vehicle 10 and fixation devices disposed on or in the animated FIG. 14 (e.g., on or in the center portion of a body such as abdomen and on or in appendage extremities such as the hands and/or feet of appendages or limbs). One of the sets of fixations devices, either on or in the surface 16 of the ride vehicle 10 or on or in the animated FIG. 14, are actively controlled to alternately couple or uncouple specific points of contact between the animated FIG. 14 and the surface 16, while one or more actuators are actively controlled on or in the animated FIG. 14 to move one or more of the appendages (e.g., limbs) or portions of the body of the animated FIG. 14 where the points of contact are located to enable the animated FIG. 14 to move on the surface 16.

In certain embodiments, the fixation devices include switchable electromagnets or switchable permanent magnets on or in the surface 16 of the ride vehicle 10 and magnets (e.g., permanent magnets) disposed on or in the animated FIG. 14 at the points of contact. In certain embodiments, the fixation devices include magnets (e.g., permanent magnets) disposed on or in the surface 16 of the ride vehicle 10 and switchable electromagnets or switchable permanent magnets on or in the animated FIG. 14 at the points of contact. In certain embodiments, the animated FIG. 14 may solely include the fixation devices (e.g., switchable electromagnets or switchable permanent magnets) and the surface 16 of the ride vehicle 10 may include magnetic material (e.g., ferromagnetic materials) to interact with fixation devices. In certain embodiments, the fixation devices may include holes in the surface 16 of the ride vehicle 10 that are coupled to a vacuum pump that generates a suction effect to selectively hold the points of contact of the animated FIG. 14 on, in, or covering a respective hole as the animated FIG. 14 moves along the surface 16. In certain embodiments, the vacuum pump may be coupled to the points of contact on or in the animated FIG. 14 to keep the points of contact held on, in, or covering a respective hole as the animated FIG. 14 moves along the surface 16.

In the illustrated embodiment, the animated FIG. 14 includes at least three points of contact with the surface 16. Two points of contact are configured to be alternately coupled and uncoupled to the surface 16 while another point of contact is configured to maintain constant contact (e.g., sliding or rolling contact) with the surface 16. In other embodiments, different numbers of points of contact may be employed. In certain embodiments, the animated FIG. 14 and/or the surface 16 may include one or more proximity sensors (e.g., magnetic proximity sensor, capacitive proximity sensor, ultrasonic proximity sensor, etc.). The proximity sensors may provide positional information with respect to the animated figure and/or the surface 16 to coordinate the movement of the animated FIG. 14.

As depicted in FIG. 1, initially during the ride, the animated FIG. 14 is disposed along the surface 16 such that it is out of the view of the passengers 18 (e.g., as indicated in a first position 20). Eventually during the ride, the animated FIG. 14 moves (e.g., crawls) along the surface 16 along the planned path to appear in the view of the passengers 18 (e.g., as indicated in a second position 22) to provide a unique visual effect to the passengers 18. In certain embodiments, the animated FIG. 14 may not be initially on the ride vehicle 10 but attach to the ride vehicle 10 during the ride.

Figure 2:
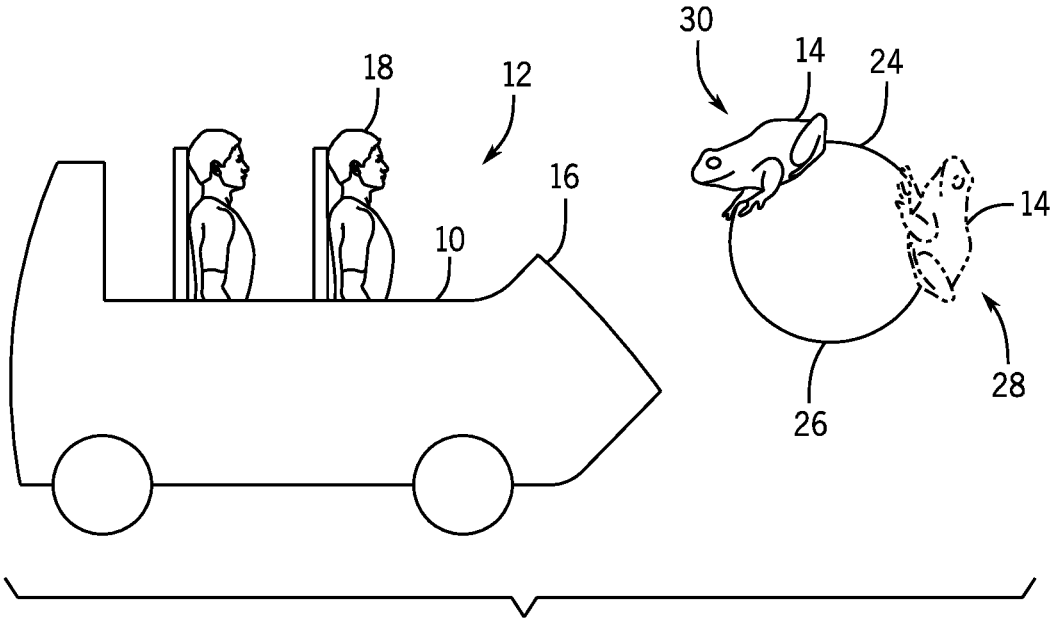
FIG. 2 is a schematic view of a ride vehicle in a ride environment wherein an animated figure is depicted as moving (e.g., crawling) on a surface along a piece of show action equipment, in accordance with aspects of the present disclosure.

FIG. 2 is a schematic view of the ride vehicle 10 in the ride environment 12 wherein the animated FIG. 14 is moving (e.g., crawling) on a surface 24 of a piece of show action equipment 26. Both the embodiment shows in FIG. 1 and the embodiment shown in FIG. 2 utilize a similar system, as described in greater detail below. As depicted in FIG. 2, the ride vehicle 10 is moving through the ride environment 12 (e.g., of an amusement attraction at an amusement or theme park). Instead of moving (e.g., crawling) along the surface 16 of the ride vehicle 10 as depicted in FIG. 1, the animated FIG. 14 shown in FIG. 2 moves (e.g., crawls) along the surface 24 of the piece of show action equipment 26. In certain embodiments, the animated FIG. 14 maneuvers along the surface 24 of the piece of show action equipment 26 as part of a show as opposed to a ride. In certain embodiments, the animated FIG. 14 is attached to the surface 24 in a non-permanent manner. In certain embodiments, the animated FIG. 14 is attached to the surface 24 in a permanent manner. As depicted in FIG. 2, initially during the ride, the animated FIG. 14 is disposed along the surface 24 out of the view of the passengers 18 (e.g., as indicated in a first position 28). Eventually during the ride, the animated FIG. 14 moves (e.g., crawls) along the surface 24 along the planned path to appear in the view of the passengers 18 (e.g., as indicated in a second position 30) to provide a unique visual effect to the passengers 18.

Figure 3:
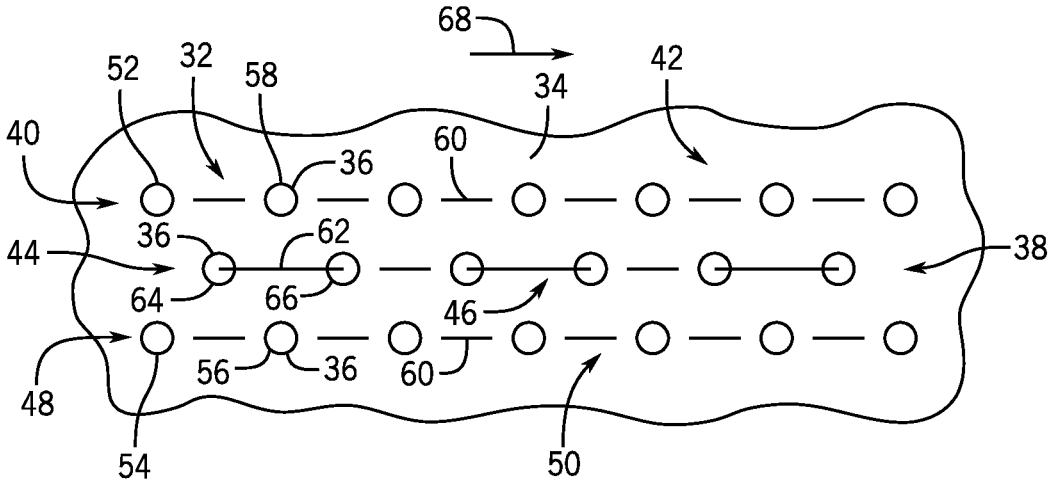
FIG. 3 is a schematic view of a portion of a fixation system along a surface to enable coupling and movement of an animated figure along the surface, in accordance with aspects of the present disclosure.

FIG. 3 is a schematic view of a portion of a fixation system 32 along a surface 34 to enable attachment and movement (e.g., crawling) of the animated figure (e.g., animated FIG. 14 in FIGS. 1 and 2) along the surface 34. The surface 34 may be a surface of a ride vehicle (e.g. surface 16 in FIG. 1), a surface of a piece of show action equipment (e.g., surface 24 in FIG. 2), or the like. The fixation system 32 includes fixation devices 36 disposed on or in the surface 34 along a planned path 38. As depicted, the planned path 38 is straight. In certain embodiments, the planned path 38 is curved or the planned path 38 includes one or more portions that are straight and one or more portions that are curved.

The fixation system 32 include a first set 40 of fixation devices 36 disposed along a first path 42 of the planned path 38, a second set 44 of fixation devices 36 disposed along a second path 46 of planned path 38, and a third set 48 of fixation devices 36 disposed along a third path 50 of the planned path 38. The fixation devices 36 of the respective sets 40, 44, 48 are spaced apart along their respective paths 42, 46, 50. The paths 42, 46, and 50 generally extend parallel (e.g., but not necessarily exactly parallel in a rigidly mathematical sense along the entire planned path 38) with respect to each other along the planned path 38. The path 46 is disposed between the paths 42, 50. In an embodiment, the planned path 38 may include a different number of paths form those depicted in FIG. 3 (e.g., 4, 5, 6, or another number of paths) associated with fixation devices 36.

The first set 40 of fixation devices 36 are configured to interact with a first point of contact (e.g., in an appendage extremity, such as a hand or foot on one side) of the animated figure. The third set 48 of fixation devices 36 are configured to interact with a second point of contact (e.g., another appendage extremity, such as a hand or foot on an opposite side) of the animated figure different from the first point of contact. The second set 44 of fixation devices 36 are configured to interact with a third point of contact (e.g., in the abdomen or central portion of the body located between the first and second points of contact) of the animated figure. In certain embodiments, the first set 40 of fixation devices 36 are configured to interact with a first set of points of contact (e.g., front and rear appendage extremities, such as hands or feet on one side) of the animated figure. In certain embodiments, the third set of 48 of fixation devices 36 are configured to interact with a second set of points of contact (e.g., appendage extremities, such as front and rear hands or feet on the opposite side). In an embodiment, the animated figure may include more than 3 points of contact (e.g., 4, 5, 6, or another number of points of contact). In an embodiment, some of the points of contact may move along a same path. In an embodiment, each point may move along its own separate path.

The first point of contact and the second point of contact of the animated figure are selectively coupled or uncoupled to the respective sets 40, 48 of fixation devices 36 as the animated figure moves (e.g., crawls) along the planned path 38. For example, as the first point of contact of the animated figure is coupled to fixation device 52 of the first set 40 of fixation devices 36, the second point of contact of the animated figure is uncoupled from the fixation device 54 of the second set 48 of fixation devices 36, moves toward the fixation device 56 of the second set 48 of fixation devices 36 (e.g., due to an actuator moving a limb having the second point of contact), and couples to the fixation device 56. Subsequently, as the second point of contact of the animated figure is coupled to fixation device 56 of the second set 48 of fixation devices 36, the first point of contact of the animated figure is uncoupled from the fixation device 52 of the first set 40 of fixation devices 36, moves toward the fixation device 58 of the first set 40 of fixation devices 36 (e.g., due to an actuator moving an appendage or limb having the first point of contact), and attaches to the fixation device 58 of the first set 40 of fixation devices 36. This coupling and uncoupling movements of the first and second point of contact of the animated figure are indicated by lines 60 between adjacent fixation devices 36 of the respective sets 40, 48 of fixation devices 36. As the first and second points of contact of the animated figure move along the respective paths 42, 50, the third point of contact moves between adjacent fixation devices 36 of the second set 44 of fixation devices via a constant contact (e.g., sliding or rolling contact) as indicated by lines 62 extending from one fixation device 36 to an adjacent fixation device 36. The sliding or rolling may occur once the feet or hands (of front limbs or back limbs) of the animated figure are even along their respective paths 42, 46. For example, once the first point of contact and the second point of contact are at the respective fixation devices 58, 56, the third point of contact may slide from a fixation device 64 to a fixation device 66 of the second set 44 of fixation devices 36. This sequence of movements enables the animated figure to move (e.g., crawl) along the planned path 38 (e.g., in a direction 68). At least two points of contact of the animated figure maintain contact with the surface 34 during movement (e.g., either the first point of contact or the second point of contact in combination with the third point of contact). At certain points, three points of contact of the animated figure maintain contact with the surface 34 (e.g., while the third point of contact slides between fixation devices 36).

In certain embodiments, the fixation devices 36 on or in the surface 34 are switchable electromagnets or switchable permanent magnets that are actively turned on and off to couple or uncouple with the points of contact (which have permanent magnets) on or in the animated figure. In certain embodiments, the fixation devices 36 on or in the surface 34 are permanent magnets that interact with switchable electromagnets or switchable permanent magnets on or in the points of contact in the animated figure that are actively turned on and off to couple or uncouple the points of contact. Engagement between one of the fixation devices 36 and a point of contact may occur when an actuator moves them together such that associated magnetic forces pull them into contact.

In certain embodiments, the locations of the fixation devices 36 may include magnetic material (e.g., ferromagnetic materials). The magnetic material may interact with fixation devices (e.g., switchable electromagnets or switchable permanent magnets) on or in the animated figure.

In certain embodiments, the fixation devices 36 are holes on or in the surface 34. In certain embodiments, the holes are coupled to a vacuum pump that generates a suction effect to selectively hold the points of contact of the animated figure on, in, or covering a respective hole as the animated figure moves along the surface 34. In certain embodiments, the vacuum pump may be coupled to the points of contact in the animated figure to keep the points of contact held on, in, or covering a respective hole as the animated FIG. 14 moves along the surface 16. Engagement between one of the fixation devices 36 and a point of contact may occur when an actuator moves them together such that suction forces pull them into contact.

In certain embodiments, the surface 34 may include one or more proximity sensors (e.g., magnetic proximity sensor, capacitive proximity sensor, ultrasonic proximity sensor, etc.). The proximity sensors may provide positional information with respect to the animated figure and/or the surface 16 to coordinate the movement of the animated figure.

Figure 4:
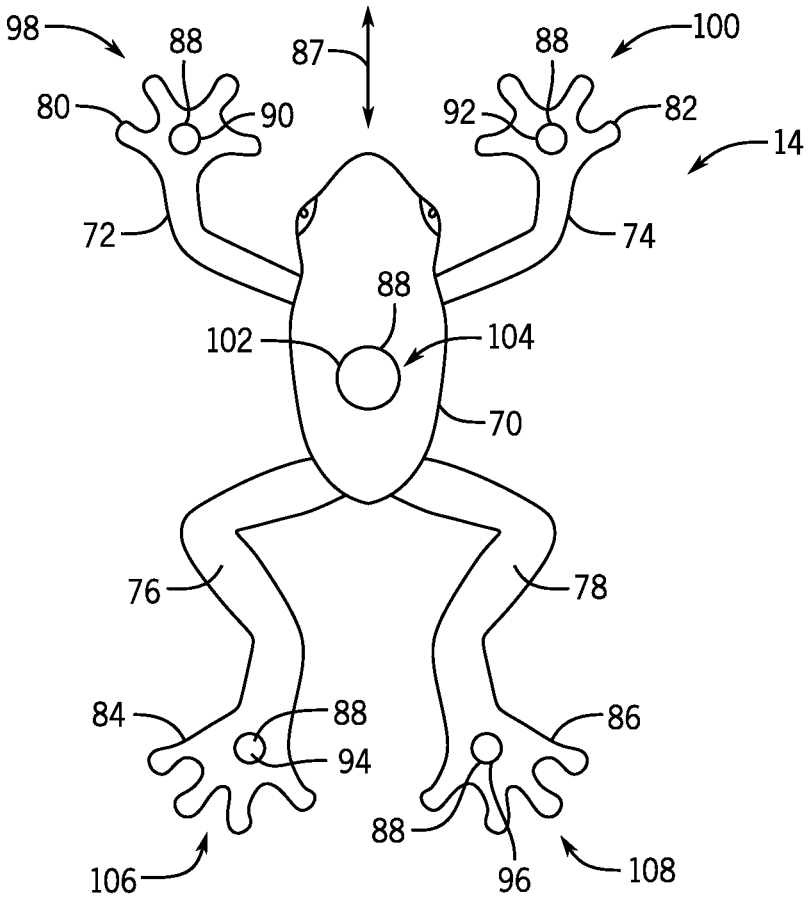
FIG. 4 is a schematic view of an animated figure having another portion of a fixation system, in accordance with aspects of the present disclosure.

FIG. 4 is a schematic view (e.g., top view) of the animated FIG. 14 having another portion of the fixation system 32. As depicted, the animated FIG. 14 is a frog. As noted above, the characteristics (including number of extremities, such as limbs, and number of points of contact) of the animated FIG. 14 may vary. As depicted, the animated FIG. 14 includes a central body portion 70 (e.g., abdomen, belly, or torso) coupled to appendages (e.g., limbs) 72, 74, 76, 78 having appendage extremities (e.g., feet or hands) 80, 82, 84, 86, respectively. Each appendage 72, 74, 76, 78 may be associated with a respective actuator (see FIG. 7) to move the appendages 72, 74, 76, 78 in a direction 87 along the planned path (e.g., planned path 38 in FIG. 3) on the surface (e.g., surface 34 in FIG. 3). The fixation system 32 includes fixation devices 88 disposed in the appendage extremities 80, 82, 84, 86. In particular, fixation devices 90, 92, 94, 96 are disposed on or in the appendage extremities 80, 82, 84, 86, respectively. The appendage extremity 80 and the fixation device 90 form a first point of contact 98 configured to interact with a first set of fixation devices (e.g., set 40 of fixation devices 36 along path 42 in FIG. 3) along the planned path (e.g., planned path 38 in FIG. 3) on the surface (e.g., surface 34 in FIG. 3). The appendage extremity 82 and the fixation device 92 form a second point of contact 100 configured to interact with a second set of fixation devices (e.g., set 48 of fixation devices 36 along the path 50 in FIG. 3) along the planned path (e.g., planned path 38 in FIG. 3) on the surface (e.g., surface 34 in FIG. 3). The central body portion 70 includes a fixation device 88 (e.g., fixation device 102) that forms a third point of contact 104 (e.g., constant sliding or rolling point of contact) configured to interact with a third set of fixation devices (e.g., set 44 of fixation devices 36 along the path 46 in FIG. 3) along the planned path (e.g., planned path 38 in FIG. 3) on the surface (e.g., surface 34 in FIG. 3). The appendage extremity 84 and the fixation device 94 form a fourth point of contact 106 configured to interact with a first set of fixation devices (e.g., set 40 of fixation devices 36 along path 42 in FIG. 3) along a planned path (e.g., planned path 38 in FIG. 3) on the surface (e.g., surface 34 in FIG. 3). The appendage extremity 86 and the fixation device 94 form a fifth point of contact 108 configured to interact with a second set of fixation devices (e.g., set 48 of fixation devices 36 along the path 50 in FIG. 3) along the planned path (e.g., planned path 38 in FIG. 3) on the surface (e.g., surface 34 in FIG. 3). Thus, the first and fourth points of contact 98, 106 move along a same path of fixation devices, while the second and fourth points of contact 100, 108 move along a same path of fixation devices.

In certain embodiments, the fixation devices 88 on or in the animated FIG. 14 are permanent magnets configured to interact with the fixation devices 35 of the surface 34 (e.g., switchable electromagnets or switchable permanent magnets in the surface 34) that are actively turned on and off to couple or uncouple with the points of contact 98, 100, 104, 106, 108 in the animated FIG. 14. In certain embodiments, the fixation devices 88 on or in the animated FIG. 14 are the switchable electromagnets or switchable permanent magnets that are actively turned on and off to couple or uncouple the points of contact 98, 100, 104, 106, 108 of the animated figure with permanent magnets (e.g., fixation devices 36) in the surface 34.

In certain embodiments, the animated FIG. 14 may include one or more proximity sensors (e.g., magnetic proximity sensor, capacitive proximity sensor, ultrasonic proximity sensor, etc.). The proximity sensors may provide positional information with respect to the animated FIG. 14 and/or the surface to coordinate the movement of the animated FIG. 14.

Figure 5:
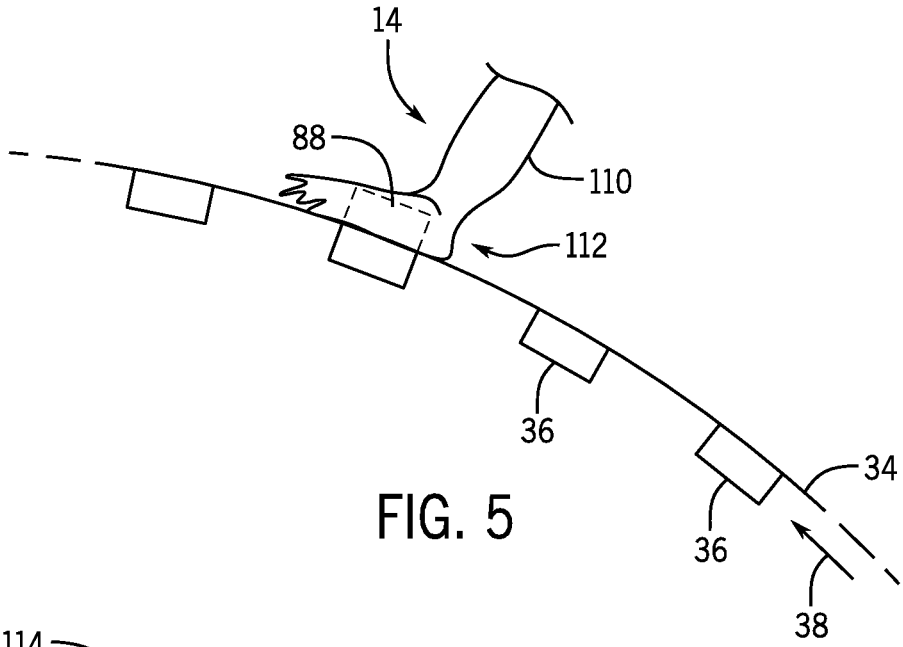
FIG. 5 is a schematic view of an appendage extremity (e.g., a hand or foot) of an animated figure interacting with a surface, in accordance with aspects of the present disclosure.

FIG. 5 is a schematic view of an appendage extremity 110 (e.g., hand or foot) of the animated FIG. 14 interacting with the surface 34. The surface 34 may be a surface of a ride vehicle (e.g., surface 16 in FIG. 1) or a surface of a piece of show action equipment (e.g., surface 24 in FIG. 2). The appendage extremity 110 includes the fixation device 88. The fixation device 88 and the appendage extremity 110 form a point of contact 112 (e.g., of point of contact 98, 100, 106, or 108) on the animated FIG. 14 that interfaces with the surface 34. The surface 34 includes a set of fixation devices 36 (e.g., set 40 or set 48 in FIG. 3) disposed along the planned path 38. The set of fixation devices 36 may be disposed along one of the paths (e.g., path 42 or path 50 in FIG. 3) of the planned path 38. An actuator of the extremity (e.g., limb) that the appendage extremity 110 (e.g., hand or foot) is coupled with moves the appendage extremity 110 from one fixation device 36 to an adjacent fixation device 36 when the fixation device 88 is not being actively coupled to a particular fixation device 36.

In certain embodiments, the fixation device 88 on or in the appendage extremity 110 is a permanent magnet configured to interact with the switchable electromagnets or switchable permanent magnets (e.g., fixation devices 36) on or in the surface 34 that are actively turned on and off to couple or uncouple with the point of contact 112 (e.g., fixation device 88) in the animated FIG. 14. In certain embodiments, the fixation device 88 on or in the animated FIG. 14 is a switchable electromagnet or switchable permanent magnet that is actively turned on and off to couple or uncouple the point of contact 112 of the animated FIG. 14 with permanent magnets (e.g., fixation devices 36) on or in the surface 34.

Figure 6:
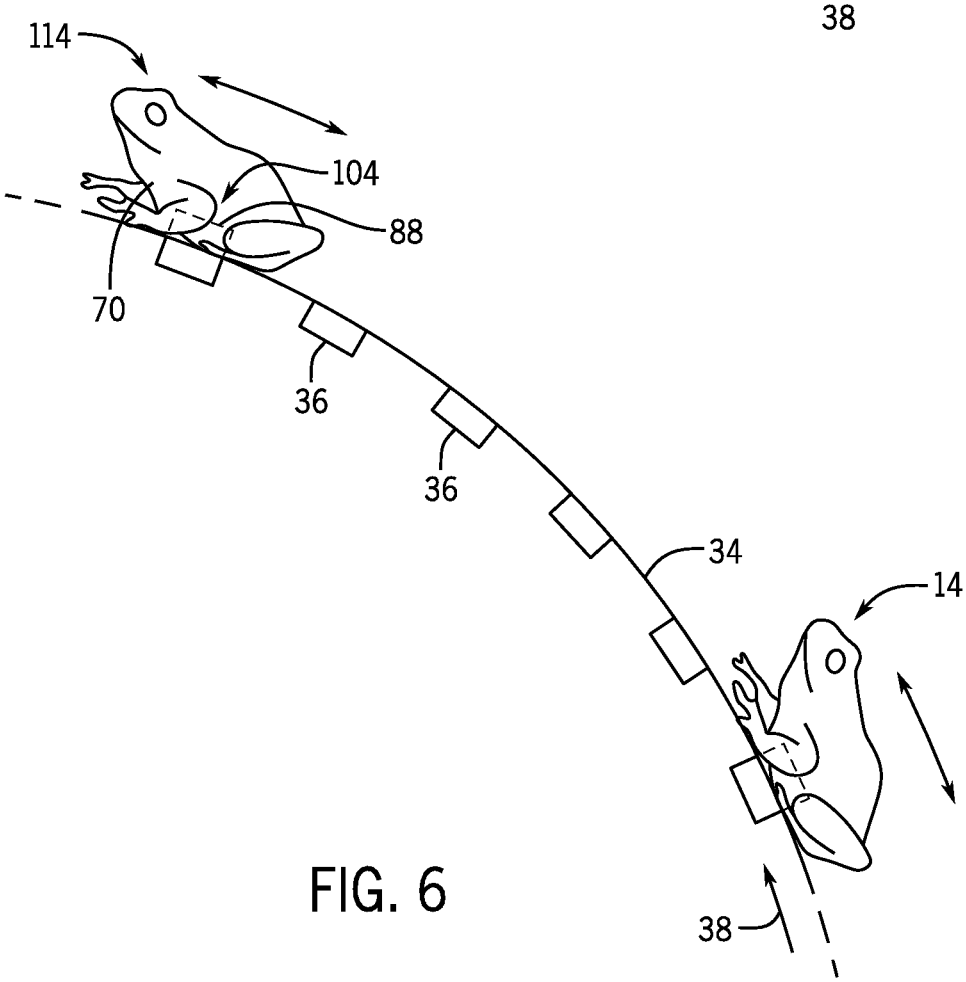
FIG. 6 is a schematic view of a central body portion of an animated figure interacting with a surface, in accordance with aspects of the present disclosure.

FIG. 6 is a schematic view of the central body portion 70 the animated FIG. 14 interacting with the surface 34. The surface 34 may be a surface of a ride vehicle (e.g. surface 16 in FIG. 1) or a surface of a piece of show action equipment (e.g., surface 24 in FIG. 2). The central body portion 70 includes the fixation device 88. The fixation device 88 and the central body portion form the point of contact 104 on the animated FIG. 14 that interfaces with the surface 34. The surface 34 includes a set of fixation devices 36 (e.g., set 44 in FIG. 3) disposed along the planned path 38. The set of fixation devices 36 may be disposed along one of the paths (e.g., path 46 in FIG. 3) of the planned path 38. While the actuators are moving the limbs of the animated figure, the point of contact 104 (e.g., fixation device 88) remains coupled to a particular fixation device 36 (e.g., in a hold down position) due to the switchable electromagnet or switchable permanent magnet being active. Upon the points of contact of the limbs reaching a fixed position (e.g., when the front limbs are even along the planned path 38), the point of contact 104 (e.g., fixation device 88) may slide from the particular fixation device 36 to an adjacent fixation device 36 as the switchable electromagnet or switchable permanent magnet is deactivated. Upon reaching the adjacent fixation device 36, a hold position is resumed between the point of contact 104 and the surface 34.

In certain embodiments, the fixation device 88 in the central body portion 70 is a permanent magnet configured to interact with the switchable electromagnets or switchable permanent magnets (e.g., fixation devices 36) in the surface 34 that are actively turned on and off to couple or uncouple with the point of contact 104 (e.g., fixation device 88) in the animated FIG. 14. In certain embodiments, the fixation device 88 in the animated FIG. 14 is a switchable electromagnet or switchable permanent magnets that is actively turned on and off to couple or uncouple the point of contact 104 of the animated FIG. 14 with permanent magnets (e.g., fixation devices 36) in the surface 34. In certain embodiments, the animated figured 14 may interact directly on a matrix of spaced-out fixation devices 36 (i.e., without a surface in between).

Figure 7:
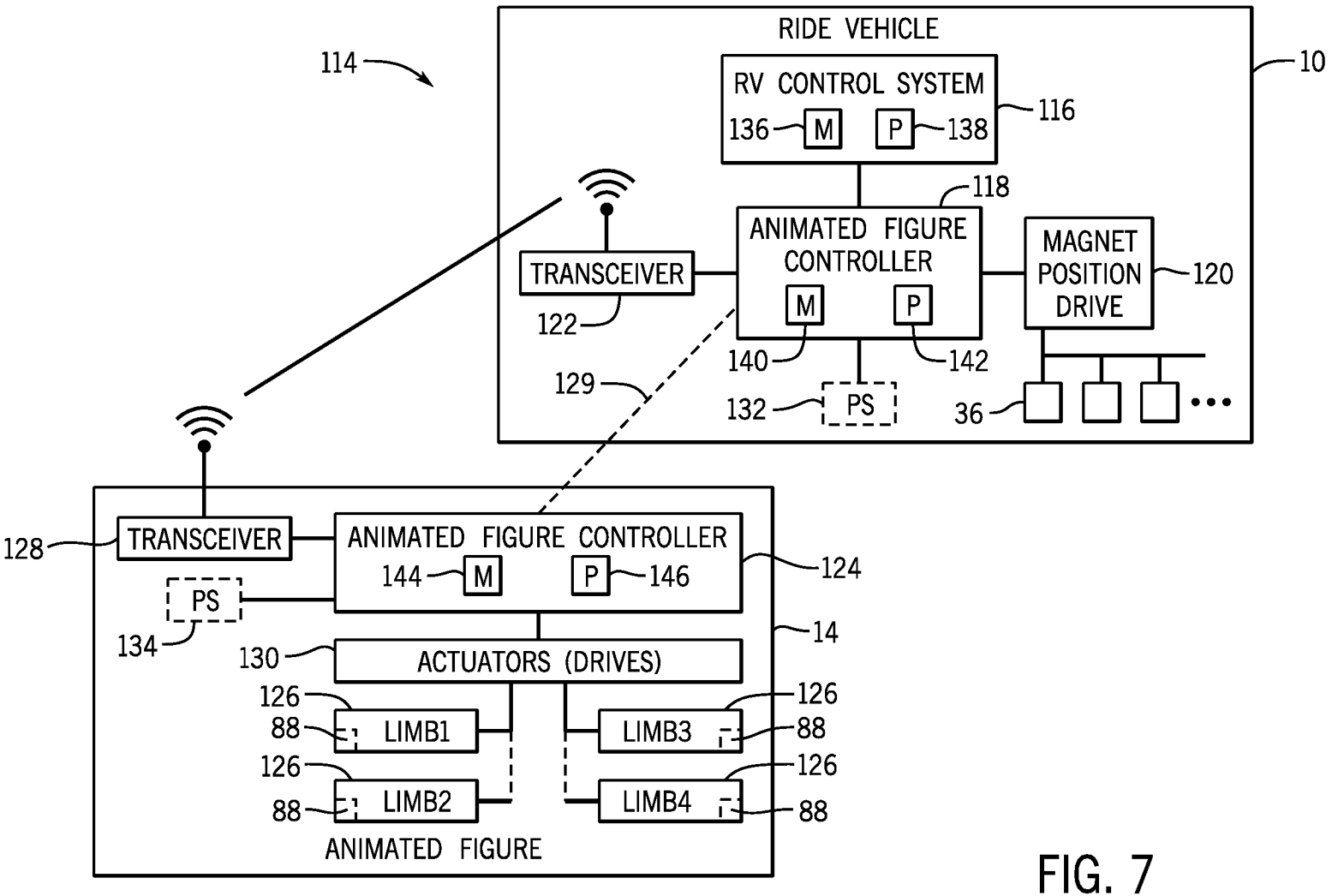
FIG. 7 is a schematic view of a system for controlling movement of an animated figure on a surface of a ride vehicle (e.g., utilizing magnets), in accordance with aspects of the present disclosure.

FIG. 7 is a schematic view of a system 114 for controlling movement (e.g., crawling) of the animated FIG. 14 on or in a surface of the ride vehicle 10 (e.g., utilizing magnets). The system 114 includes the ride vehicle 10 and the animated FIG. 14. The ride vehicle 10 includes a ride vehicle control system 116. The ride vehicle (RV) control system 116 controls the operations of the ride vehicle 10. The ride vehicle control system 116 is coupled to a first animated figure controller 118 located on or in the ride vehicle 10. The ride vehicle control system 116 provides control signals to the first animated figure controller 118 to coordinate operation of the animated FIG. 14 with the ride vehicle 10. The first animated figure controller 118 is coupled to a magnet position drive 120. The magnet position drive 120 is coupled to the fixation devices 36 disposed on or in the surface of the ride vehicle 10. The fixation devices 36 are switchable electromagnets or switchable permanent magnets that can be activated or deactivated (in response to control signals provided to the magnet position drive 120 from the animated figure controller 118) to cause the selective coupling or uncoupling between fixation devices 36, located on or in the surface of the ride vehicle 10, and the fixation devices 88, located at the points of contact on or in the animated FIG. 14, to keep the animated FIG. 14 coupled to the ride vehicle as it moves (e.g., crawls) along the planned path.

The animated figure controller 118 is also coupled to a transceiver 122 (e.g., radio frequency (RF) transceiver) for communicating with the animated FIG. 14. The animated figure controller 118 may provide control signals to the animated FIG. 14 to control movement of the animated FIG. 14 in coordination with the selective activation and deactivation of the fixation devices 36 on or in the surface of the ride vehicle 10.

The animated FIG. 14 includes an animated figure controller 124 that is configured to control the actuation of appendages 126 (e.g., limbs) on the animated FIG. 14 (e.g., to move the points of contacts associated with the appendages 126). The animated FIG. 14 includes a transceiver 128 (e.g., RF transceiver) coupled to the animated figure controller 124 to enable communication with the animated figure controller 118 to coordinate movement of the appendages 126 with the selective activation and deactivation of the fixation devices 36. In an embodiment, the animated figure controllers 118, 124 may be communicatively coupled via a wired connection (e.g., as indicated by dashed line 129).

The animated figure controller 124 is coupled to actuators 130 (e.g., drives) that cause movement of movement of the appendages 126 (e.g., limbs) in response to control signals from the animated figure controller 124. The point of contact (e.g., appendage extremity (e.g., hand or foot)) of each appendage 126 includes a fixation device (e.g., permanent magnet) configured to interact with the fixation devices 36 on or in the surface of the ride vehicle 10.

In certain embodiments, the ride vehicle 10 may include one or more proximity sensors 132 (e.g., magnetic proximity sensor, capacitive proximity sensor, ultrasonic proximity sensor, etc.) disposed adjacent to the fixation devices 36. In certain embodiments, the animated FIG. 14 may also include one or more proximity sensors 134. The proximity sensors 132, 134 may provide positional information with respect to the animated FIG. 14 and/or the surface to coordinate the movement of the animated FIG. 14.

In certain embodiments, the configuration of the system 114 may vary. For example, the fixation devices 36 on or in the ride vehicle 10 may be the permanent magnets and the fixation devices 88 on or in the animated FIG. 14 may be switchable electromagnets or the switchable permanent magnets. In this embodiment, the magnet position drive 120 is located on or in the animated FIG. 14 and coupled to the fixation devices 88.

In certain embodiments, the animated figure controller 118, the fixation devices 36, and/or the magnet position device 120 are located on or in a piece of show action equipment. In this embodiment, the animated figure controller 118 may be in communication with the ride vehicle control system 116 (when the show action equipment is part of a ride) or a control system for a show (when the show action equipment is part of a show).

The ride vehicle control system 116 includes a memory 136 and a processor 138. The first animated figure controller 118 also includes a memory 140 and a processor 142. The second animated figure controller 124 further includes a memory 144 and a processor 146. In some embodiments, the processors 138, 142, 146 may include one or more general purpose processors, one or more application specific integrated circuits, one or more field programmable gate arrays, or the like. Additionally, the memories 136, 140, 144 may be any tangible, non-transitory, computer readable medium that is capable of storing instructions executable by the respective processors 138, 142, 146 and/or data that may be processed by the processors 138, 142, 146. In other words, the memories 136, 140, 144 may include volatile memory, such as random-access memory, or non-volatile memory, such as hard disk drives, read only memory, optical disks, flash memory, and the like.

Figure 8:
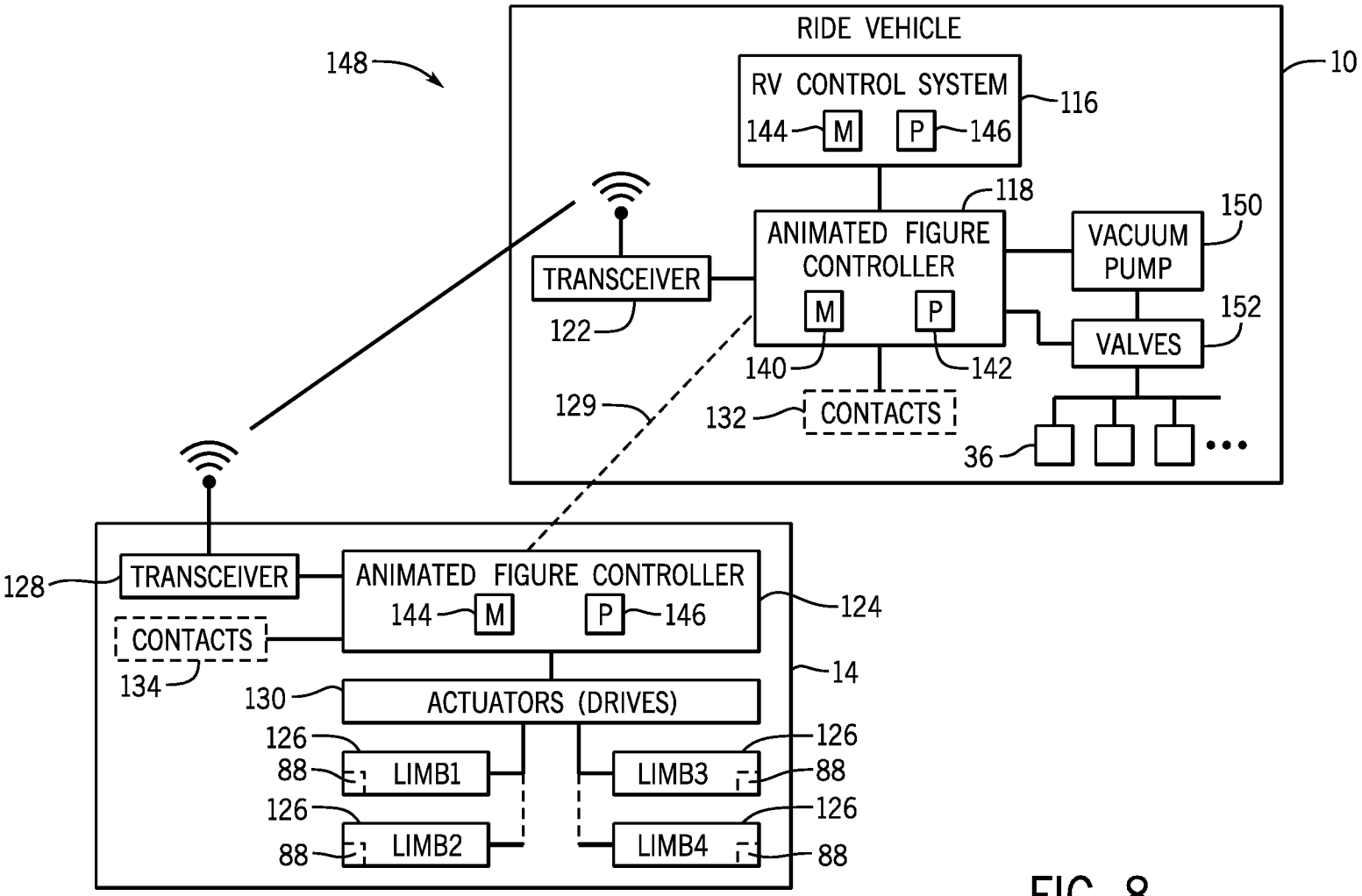
FIG. 8 is a schematic view of a system for controlling movement of an animated figure on a surface of a ride vehicle (e.g., utilizing a vacuum pump), in accordance with aspects of the present disclosure.

FIG. 8 is a schematic view of a system 148 for controlling movement (e.g., crawling) of the animated FIG. 14 on a surface of the ride vehicle 10 (e.g., utilizing a vacuum pump). The system 148 is similar to the system 114 in FIG. 7 with a few differences. The fixation devices 36 are holes in the surface of the ride vehicle 10. The ride vehicle 10 includes a vacuum pump 150 coupled to the fixation devices 36 (e.g., via conduits) to create a suction effect to secure (e.g., hold) the points of contacts (e.g., appendage extremities (e.g., hands or feet)) of the appendages 126 (e.g., limbs) in the fixation devices 36. Valves 152 are coupled to the respective conduits coupled to the fixation devices 36. The animated figure controller 118 provides control signals to the valves to selectively create the suction effect in the fixations devices 36 to cause the selective coupling or uncoupling between fixation devices 36 and the points of contact on the animated FIG. 14 to keep the animated FIG. 14 coupled to the ride vehicle as it moves (e.g., crawls) along the planned path. In certain embodiments, the ride vehicle 10 may include an additional vacuum pump as a safety feature to couple the animated FIG. 14 to the ride vehicle 10 if the vacuum pump 150 does not work.

In certain embodiments, the configuration of the system 148 may vary. For example, the vacuum pump 150 and valves 152 may be located on or in the animated FIG. 14. The vacuum pump 150 may generate the suction effect at the points of contact (e.g., appendage extremities (e.g., hands or feet)) of the appendages 126 (e.g., limbs) to selectively hold them on or in the fixation devices 36 on the surface of the ride vehicle 10.

In certain embodiments, the animated figure controller 118, the fixation devices 36, the vacuum pump, and/or valves 152 are located on or in a piece of show action equipment. In this embodiment, the animated figure controller 118 may be in communication with the ride vehicle control system 116 (when the show action equipment is part of a ride) or a control system for a show (when the show action equipment is part of a show).

Figure 9:
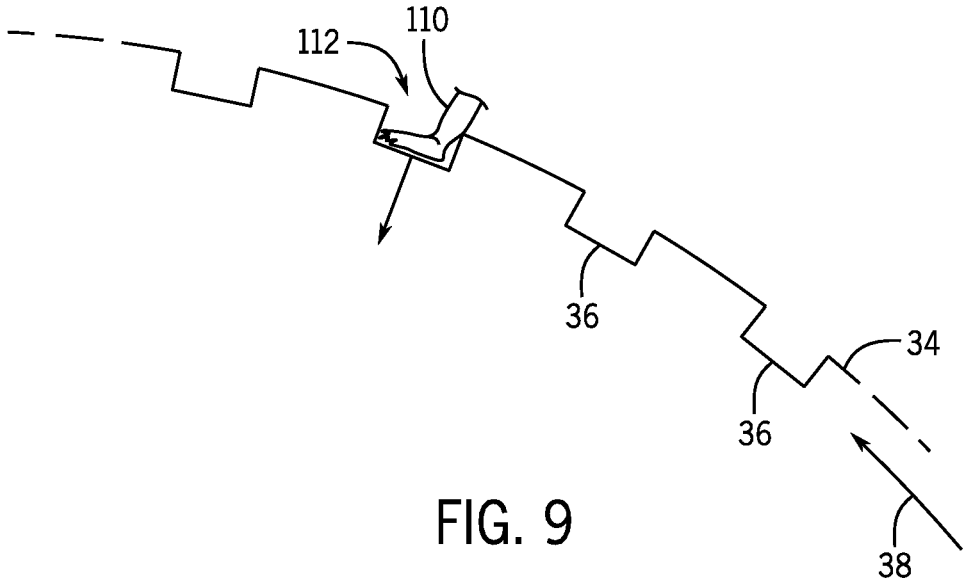
FIG. 9 is a schematic view of an appendage extremity (e.g., a hand or foot) of an animated figure interacting with a surface (e.g., via a suction effect), in accordance with aspects of the present disclosure.

FIG. 9 is a schematic view of the appendage extremity 110 (e.g., hand or foot) of the animated FIG. 14 interacting with a surface 34 (e.g., via a suction effect). The surface 34 may be a surface of a ride vehicle (e.g. surface 16 in FIG. 1) or a surface of a piece of show action equipment (e.g., surface 24 in FIG. 2). The surface 34 includes a set of fixation devices 36 (e.g., set 40 or set 48 in FIG. 3) disposed along the planned path 38. The set of fixation devices 36 may be disposed along one of the paths (e.g., path 42 or path 50 in FIG. 3) of the planned path 38. In certain embodiments, the fixation devices 36 are coupled to a vacuum pump to selectively create a suction effect in the fixation devices 36. In certain embodiments, the point of contact 112 on the appendage extremity 110 (e.g., hand or foot) is coupled to a vacuum pump to selectively create a suction effect in the point of contact 112. The suction effect couples the point of contact 112 in the fixation device 36 to couple the appendage extremity 110 to the surface 34. An actuator of the appendage that the appendage extremity 110 is coupled to moves the appendage extremity 110 from one fixation device 36 to an adjacent fixation device 36 when the point of contact 112 is not being actively coupled to a particular fixation device 36.

Figure 10:
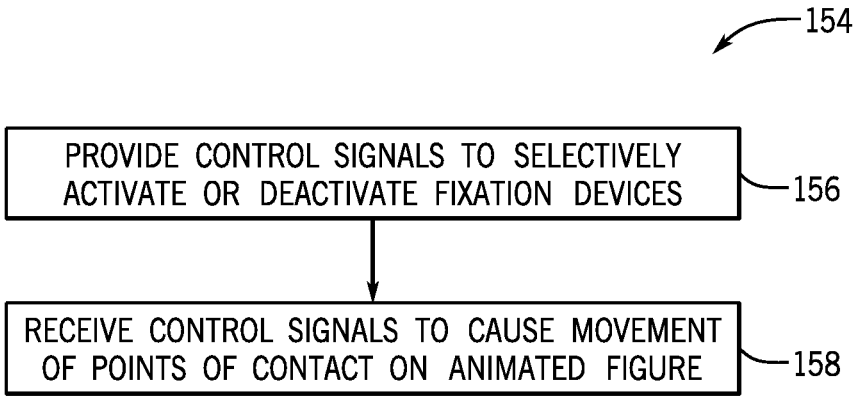
FIG. 10 is a flow chart of a method for controlling movement of an animated figure on a surface, in accordance with aspects of the present disclosure.

FIG. 10 is a flow chart of a method 154 for controlling movement (e.g., crawling) of an animated figure on a surface (e.g., the surface of a ride vehicle or a piece of shown action equipment). The steps of the method 154 may be performed by one or more of the ride vehicle control system 116, the animated figure controller 118, and the animated figure controller 124 in FIGS. 7 and 8.

The method 154 includes providing control signals to a selectively activate and deactivate fixation devices that cause the animated figure disposed on the ride vehicle or show action equipment to remain coupled to the surface of the ride vehicle or show action equipment as the animated figure crawls along the surface along a planned path (block 156). The animated figure includes at least three points of contact with the surface, wherein the at least three points of contact include a first point of contact, a second point of contact, and a third point of contact, the first point of contact and the second point of contact are configured to be alternately coupled and uncoupled to the surface while the third point of contact is configured to maintain constant contact (e.g., sliding or rolling contact) with the surface. In certain embodiments, the fixation devices to be activated and deactivated are located on or in the surface and interact with fixation devices on or in the animated figure. In certain embodiments, the fixation devices to be activated and deactivated are located on or in the animated figure (e.g., at the points of contact) and interact with fixation devices on or in the surface. In certain embodiments, the fixation devices to be activated and deactivated are switchable electromagnets or switchable permanent magnets and the activation devices they interact with are permanent magnets. In certain embodiments, the fixation devices are holes coupled to a vacuum pump that creates a suction effect in the holes.

The method 154 also includes receiving the control signals at the animated figure to cause one or more actuators on the animated figure to alternately move the first point of contact and the second point of contact along the planned path in coordination with the selective activation and deactivation of the fixation devices to cause the animated figure to move (e.g., crawl) along the surface (block 158).

Figure 11:
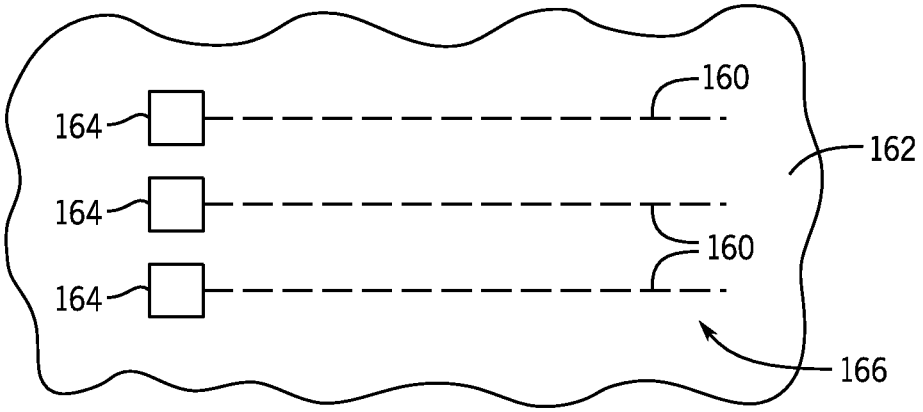
FIG. 11 is a schematic view of a path along a surface for points of contact (e.g., with each point of contact moving along a separate path along a planned path)
Figure 12:
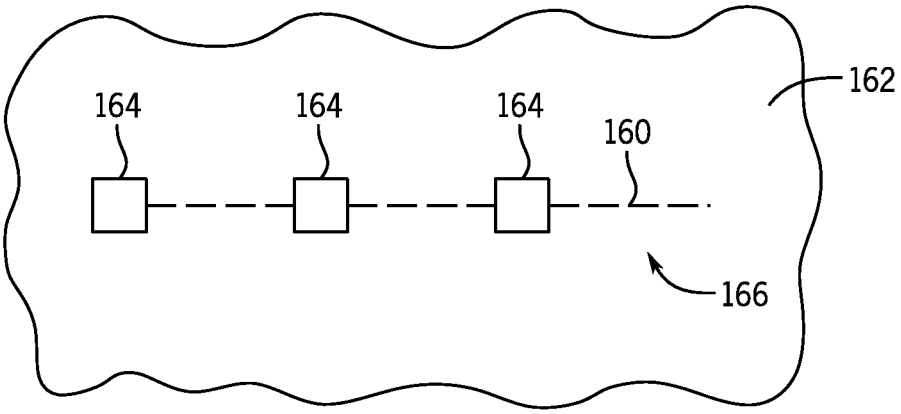
FIG. 12 is a schematic view of a path along a surface for points of contact (e.g., with each point of contact moving along a same path along a planned path)
Figure 13:
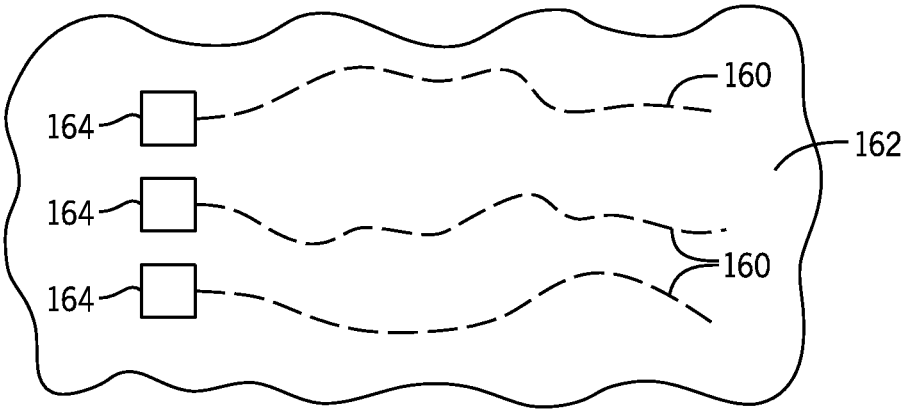
FIG. 13 is a schematic view of a path along a surface for points of contact (e.g., with each point of contact moving along a separate path that is unplanned)

FIGS. 11-13 illustrate schematic views of different ways points of contact 164 of an animated figure may move along a surface 162. The surface 162 may belong to a ride vehicle or show action equipment. Although not shown, as noted above, fixations devices may be disposed along paths 160 of the points of contact 164. As depicted in FIG. 11, each point of contact 164 moves along a separate path 160 along a planned path 166. As depicted in FIG. 12, each point of contact 164 is moving along the same path 160. As depicted in FIG. 13, each point of contact 164 moves along a separate path 160 that is unplanned.

Figure 15:
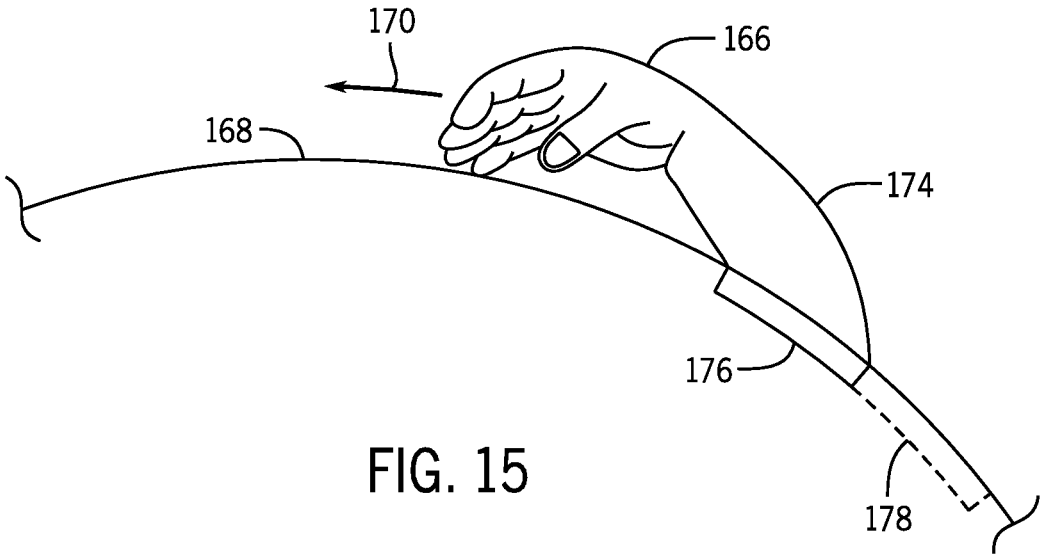
FIG. 15 is a schematic view of an animated figure moving along (and externally coupled to) a surface having at least one permanent point to point connection for a point of contact.

In an embodiments, at least point of contact of the animated figure may include a permanent point to point connection along a surface as the animated figured moves. FIGS. 14 and 15 are schematic views of an animated FIG. 166 (e.g., hand coupled to a forearm) moving along a surface 168 having at least one permanent point to point connection for a point of contact. The surface 168 may belong to a ride vehicle or an animated figure. Certain portions 170 (e.g., fingers of the hand) of the animated FIG. 166 may move along a path (as indicated by arrow 172) as described above in FIG. 3 utilizing fixation devices that are spaced apart while another portion 174 (e.g. portion of forearm further away from hand) is moves in a permanent point to point connection along the surface 162. As depicted in FIG. 14, the portion 174 is externally coupled to the surface 168. As depicted in FIG. 15, the portion 174 is internally coupled. For example, as depicted in FIG. 15, the animated FIG. 166 extends through a sleeve seal 176 that slides along a slot 178 (which is entirely or partially concealed from the rider's view).

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

While only certain features of the disclosed subject matter have been illustrated and described herein, many modifications and changes will occur to those skilled in the art. It is, therefore, to be understood that the appended claims are intended to cover all such modifications and changes as fall within the true spirit of the disclosed subject matter.

The invention claimed is:

1. An amusement attraction, comprising:

a ride vehicle;

an animated figure configured to move along a surface of the ride vehicle, wherein the animated figure comprises at least three points of contact configured to engage with the surface, wherein the at least three points of contact comprise:

a first point of contact and a second point of contact configured to be alternately engaged with and disengaged from the surface, and' a third point of contact configured to maintain contact with the surface;

a fixation system configured to keep the animated figure coupled to the ride vehicle via the at least three points of contact as the animated figure moves along the surface; and a controller configured to provide control signals to the fixation system to facilitate control of engagement of the animated figure along the surface.

2. The amusement attraction of claim 1, wherein the animated figure is configured to move along a planned path.

3. The amusement attraction of claim 2, wherein the animated figure comprises one or more actuators, and the controller is configured to provide the control signals to the one or more actuators to cause the first point of contact and the second point of contact to alternately move along the planned path to enable the animated figure to move.

4. The amusement attraction of claim 2, wherein the fixation system comprises a first plurality of fixation devices disposed on or in the surface along the planned path, wherein the first plurality of fixation devices comprises a first set of fixation devices configured to interact with the first point of contact, a second set of fixation devices configured to interact with the second point of contact, and a third set of fixation devices configured to interact with the third point of contact, wherein the first set of fixation devices is disposed along a first path along the planned path, the second set of fixation devices is disposed along a second path along the planned path, and the third set of fixation devices is disposed along a third path along the planned path.

5. The amusement attraction of claim 4, wherein the first plurality of fixation devices comprises switchable electromagnets or switchable permanent magnets, the fixation system comprises a second plurality of fixation devices, the second plurality of fixation devices comprises a plurality of magnets, and the first point of contact, the second point of contact, and the third point of contact each comprise a respective magnet of the plurality of magnets, and wherein the controller is configured to provide the control signals to the first plurality of fixation devices to selectively activate and deactivate the switchable electromagnets or switchable permanent magnets to facilitate control of engagement of the animated figure along the surface.

6. The amusement attraction of claim 4, wherein the first plurality of fixation devices comprises a plurality of magnets, the fixation system comprises a second plurality of fixation devices, the second plurality of fixation devices comprises a plurality of switchable electromagnets or switchable permanent magnets, and the first point of contact, the second point of contact, and the third point of contact each comprise a respective switchable electromagnet or switchable permanent magnet of the plurality of switchable electromagnets or switchable permanent magnets, and wherein the controller is configured to provide the control signals to the second plurality of fixation devices to selectively activate and deactivate the switchable electromagnets or switchable permanent magnets to facilitate control of engagement of the animated figure along the surface.

7. The amusement attraction of claim 4, wherein the first plurality of fixation devices comprises a plurality of holes, the fixation system comprises a vacuum pump configured to selectively provide suction to hold at least the first point of contact, the second point of contact, or the third point of contact on, in, or covering a respective hole of the plurality of holes, and wherein the controller is configured to provide the control signals to the vacuum pump to facilitate engagement of the animated figure along the surface.

8. The amusement attraction of claim 7, wherein the vacuum pump is disposed on the ride vehicle, and the vacuum pump is configured to selectively provide suction to the plurality of holes to hold at least the first point of contact, the second point of contact, or the third point of contact in the respective hole of the plurality of holes.

9. The amusement attraction of claim 7, wherein the vacuum pump is disposed on the animated figure, and the vacuum pump is configured to selectively provide suction to at least the first point of contact, the second point of contact, or the third point of contact to hold at least the first point of contact, the second point of contact, or the third point of contact on, in, or covering the respective hole of the plurality of holes.

10. The amusement attraction of claim 1, wherein the animated figure is configured to crawl along the surface.

11. The amusement attraction of claim 10, wherein the animated figure is configured, during a ride on the ride vehicle, to be initially located out of a view of a rider on the ride vehicle and then subsequently crawl into the view of the rider.

12. A ride vehicle, comprising:

a surface;

an animated figure disposed on the surface and configured to move along the surface along a planned path, wherein the animated figure comprises at least three points of contact configured to contact the surface, wherein the at least three points of contact comprise:

a first point of contact and a second point of contact configured to be alternately coupled and uncoupled to the surface, and a third point of contact configured to maintain contact with the surface;

a fixation system configured to keep the animated figure coupled to the ride vehicle as the animated figure moves along the surface; and a controller configured to provide control signals to the fixation system to facilitate control of engagement of the animated figure along the surface.

13. The ride vehicle of claim 12, wherein the animated figure is configured, during a ride on the ride vehicle, to be initially located out of a view of a rider on the ride vehicle and then subsequently move into the view of the rider.

14. The ride vehicle of claim 12, wherein the animated figure comprises one or more actuators, and the controller is configured to provide the control signals to the one or more actuators to cause the first point of contact and the second point of contact to alternately move along the planned path to enable the animated figure to move.

15. The ride vehicle of claim 14, wherein the fixation system comprises a first plurality of fixation devices disposed on or in the surface along the planned path, wherein the first plurality of fixation devices comprises a first set of fixation devices configured to interact with the first point of contact, a second set of fixation devices configured to interact with the second point of contact, and a third set of fixation devices configured to interact with the third point of contact, wherein the first set of fixation devices is disposed along a first path along the planned path, the second set of fixation devices is disposed along a second path along the planned path, and the third set of fixation devices is disposed along a third path along the planned path, wherein the first path, the second path, and the third path extend parallel with respect to each other along the planned path.

16. The ride vehicle of claim 15, wherein the first plurality of fixation devices comprises switchable electromagnets or switchable permanent magnets, the fixation system comprises a second plurality of fixation devices, the second plurality of fixation devices comprises a plurality of magnets, and the first point of contact, the second point of contact, and the third point of contact each comprise a respective magnet of the plurality of magnets, and wherein the controller is configured to provide the control signals to the first plurality of fixation devices to selectively activate and deactivate the switchable electromagnets or switchable permanent magnets to facilitate control of engagement of the animated figure along the surface.

17. The ride vehicle of claim 15, wherein the first plurality of fixation devices comprises a plurality of magnets, the fixation system comprises a second plurality of fixation devices, the second plurality of fixation devices comprises a plurality of switchable electromagnets or switchable permanent magnets, and the first point of contact, the second point of contact, and the third point of contact each comprise a respective switchable electromagnet or switchable permanent magnet of the plurality of switchable electromagnets or switchable permanent magnets, and wherein the controller is configured to provide the control signals to the second plurality of fixation devices to selectively activate and deactivate the switchable electromagnets or switchable permanent magnets to facilitate control of engagement of the animated figure along the surface.

18. The ride vehicle of claim 15, wherein the first plurality of fixation devices comprises a plurality of holes, the fixation system comprises a vacuum pump disposed on or in the ride vehicle, the vacuum pump being configured to selectively provide suction to hold at least the first point of contact, the second point of contact, or the third point of contact on, in, or covering a respective hole of the plurality of holes, and wherein the controller is configured to provide the control signals to the vacuum pump to facilitate engagement of the animated figure along the surface.

* * * * *